United States Patent [19]

Kawai

[11] Patent Number: 4,560,321

[45] Date of Patent: Dec. 24, 1985

[54] CEILING FAN

[75] Inventor: Yuzo Kawai, Nara, Japan

[73] Assignee: Kabushiki Kaisha Suiden, Osaka, Japan

[21] Appl. No.: 654,570

[22] Filed: Sep. 26, 1984

[30] Foreign Application Priority Data

Sep. 26, 1983 [JP] Japan ..... 58-179837

[51] Int. Cl.[4] ..... F04D 29/36

[52] U.S. Cl. ..... 416/23; 416/99; 416/162; 416/170 R

[58] Field of Search ..... 416/162, 166, 5, 98, 416/99, 23, 24, 170 C

[56] References Cited

U.S. PATENT DOCUMENTS

| | | | |
|---|---|---|---|
| 12,106 | 12/1854 | Stein | 416/98 X |
| 206,183 | 7/1878 | Kress | 416/98 X |
| 377,573 | 2/1888 | Murray | 416/175 R X |
| 418,190 | 12/1889 | Jones | 416/205 |
| 491,006 | 1/1893 | Boyer | 416/166 |
| 571,500 | 11/1896 | West | 416/236 A X |
| 871,729 | 11/1907 | McChord | 416/207 |
| 1,227,291 | 5/1917 | Miller | 416/170 C X |
| 1,229,243 | 6/1917 | Eberhardt | 416/99 |
| 1,362,036 | 12/1920 | Parker | 416/5 X |
| 1,409,090 | 3/1922 | Glasser | 416/5 |

FOREIGN PATENT DOCUMENTS

| | | | |
|---|---|---|---|
| 0018114 | 10/1980 | European Pat. Off. | 416/23 |
| 503971 | 4/1939 | United Kingdom | 416/165 |

*Primary Examiner*—Everette A. Powell, Jr.
*Attorney, Agent, or Firm*—Barnes & Thornburg

[57] ABSTRACT

A ceiling fan includes auxiliary vanes pivotally connected to the opposite ends of its main vanes, wherein each auxiliary vane is pivotally connected to a common bracket unit through a pull rod at its opposite end to the main vanes. The bracket unit is capable of moving up and down in accordance with the rotating direction of an electric motor along a shaft supporting the body of the fan on a ceiling. By operating a solenoid the bracket unit is connected to or disconnected from the motor. Thus the auxiliary vanes are rotated in a clockwise direction or a counter-clockwise direction, thereby changing the angle of attachment thereof to the main vanes as desired while the main vanes are in rotation.

4 Claims, 12 Drawing Figures

CEILING FAN

BACKGROUND OF THE INVENTION

The present invention relates to a ceiling fan. More particularly, the present invention relates to a ceiling fan whose main vanes are provided with auxiliary vanes capable of angular ajustment with respect to the main vanes.

It is known that warm air tends to rise and stay on the surfaces of the ceiling whereas cool air tends to stay on the floors. When a room is air-conditioned, the difference in room temperature makes the people there disagreeable. Furthermore, it leads to energy loss. In order to solve this problem, the common practice is to use an ortinary type of fan whereby the air in the room is mixed so as to equalize the temperatures upward and downward. The auxiliary fans are located on the wall of the room, or they are placed at convenient places in the rooms. However, they spoil the appearance of the rooms, and in fact it is costly to provide an extra fan or ventilator for one ceiling fan. Nevertheless, such auxiliary fans are functionally weak sufficiently to stir up the air in the room.

There are ceiling fans which are provided with auxiliary vanes fixed to the main vanes, so as to stir up the air in the room. However, the fixed ones are not efficient.

In either case warm air and cool air are separated in the room. Air stir-up, if any, is limited only to under the vanes of the fan.

OBJECTS AND SUMMARY OF THE INVENTION

The present invention aims at solving the problems pointed out above, and has for its object to provide an improved ceiling fan stirring up air in a relatively wide range.

Other objects and advantages of the present invention will become apparent from the detailed description given hereinafter; it should be understood, however, that the detailed description and specific embodiment are given by way of illustration only, since various changes and modifications within the spirit and scope of the invention will become apparent to those skilled in the art from this detailed description.

According to the present invention there is provided a ceiling fan comprising:

- a main vane connected to a driving means through a shaft;
- an auxiliary vane pivotally connected to a terminating end of the main vane;
- a supporting means for suspending the fan from a ceiling, wherein the supporting means includes a casing;
- a bracket unit slidably provided on the supporting means;
- a rod member connecting between the auxiliary vane and the bracket unit;
- a clutch means for effecting the connection and disconnection between the bracket unit and the driving means, the clutch means being accommodated in the casing; and
- a switch means for effecting the engagement and disengagement of the clutch means with the driving means.

DETAILED DESCRIPTION OF THE INVENTION

Figure 1:
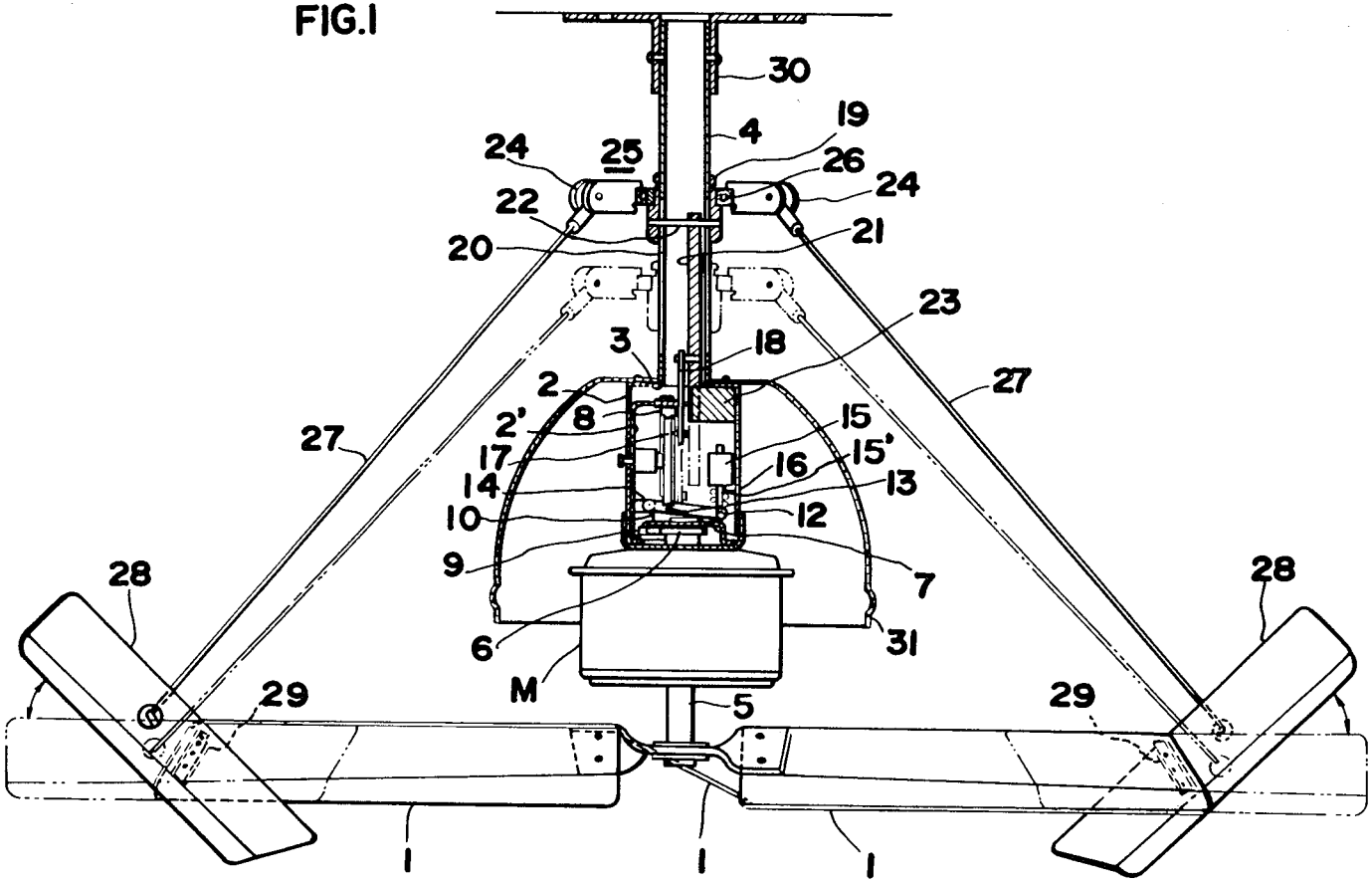
FIG. 1 is a partially sectional front view of a ceiling fan embodying the present invention.
Figure 2:
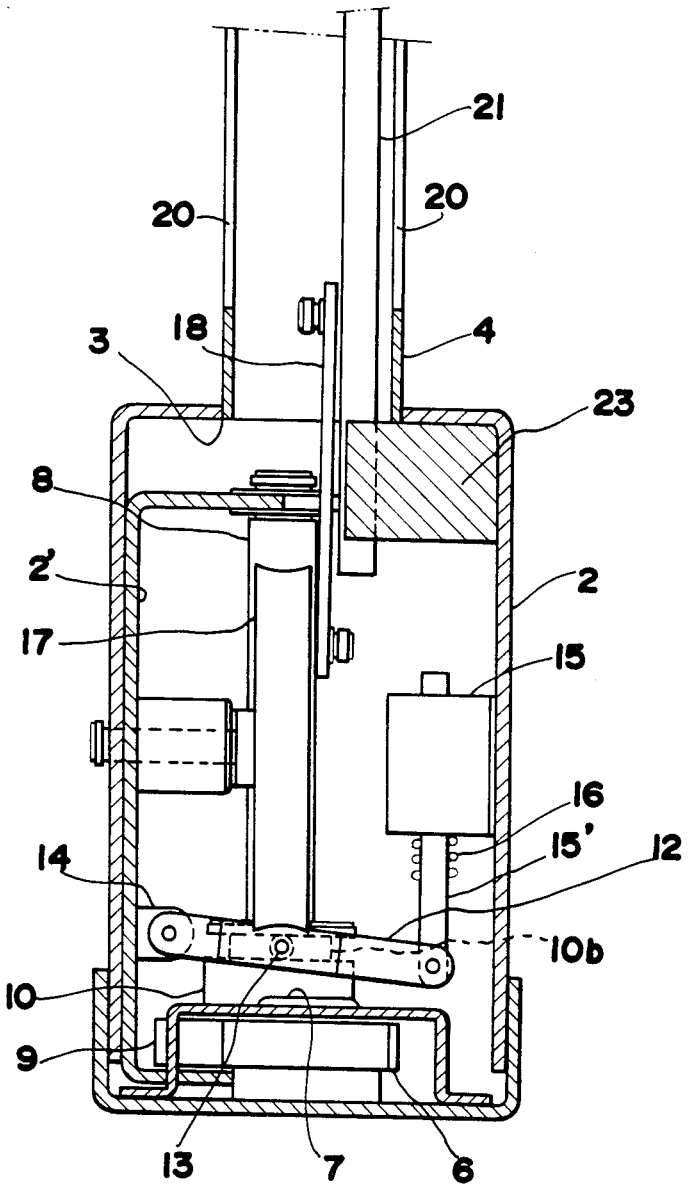
FIG. 2 is a vertical cross-section showing the internal structure of the casing particularly to exemplify the clutch mechanism.
Figure 3:
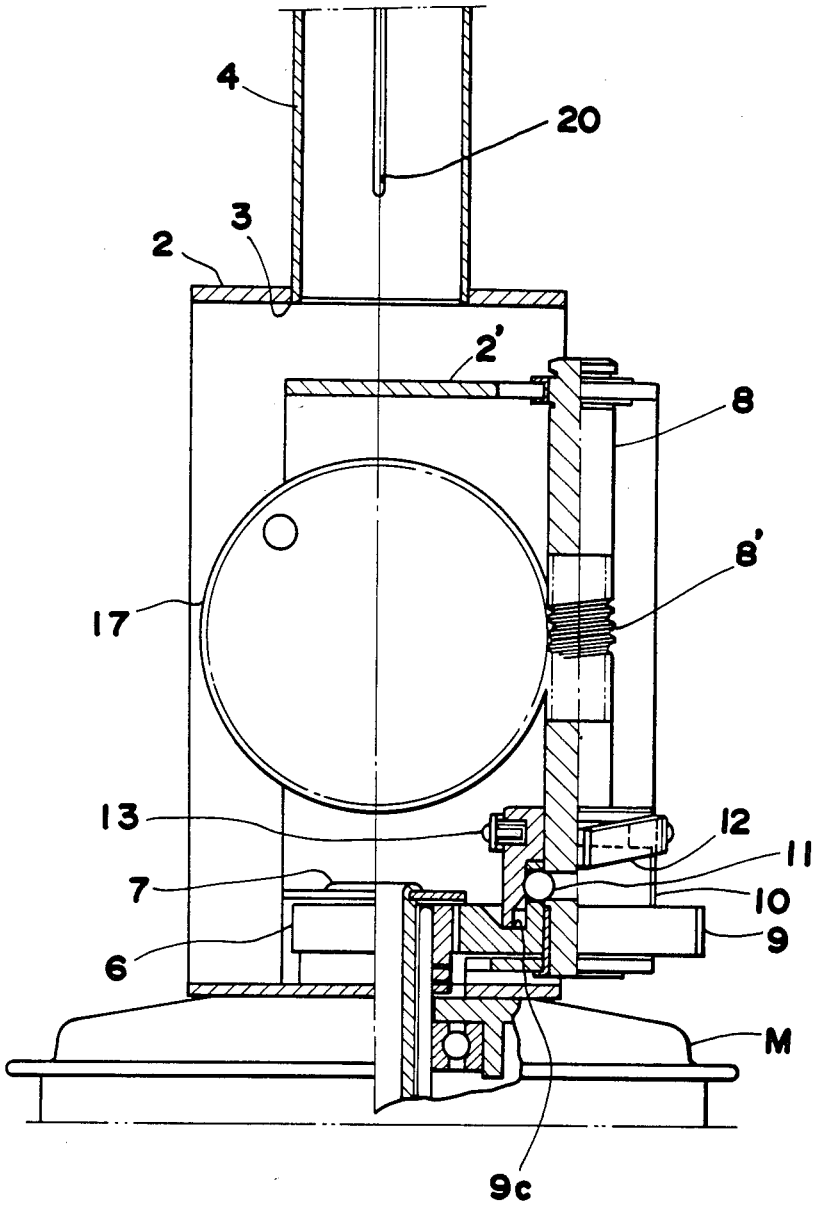
FIG. 3 is a vertical cross-section of the casing in FIG. 2 when viewed from the side.

Reffering to FIG. 1, the ceiling fan of the invention includes main vanes 1 carried on a motor shaft 5. An electric motor (M) is mounted on a pipe 4 suspended from the ceiling. As shown in FIG. 2, the pipe 4 is jointed to an outer casing 2 at a bore 3 produced therein. The outer casing 2 includes an inner casing 2'. The motor shaft 5 is connected to a main gear 6 at its opposite end to the main vanes 1. The reference numeral 7 denotes a protection cap jointed to the driving shaft 5. The inner casing 2' accommodates a shaft 8, which is rotatively supported between the upper wall and the lower wall thereof. The shaft 8 is provided with a clutch gear 9 engaged with the main gear 6. In addition, the shaft 8 includes a worm gear portion 8' in its middle section.

Figure 4:
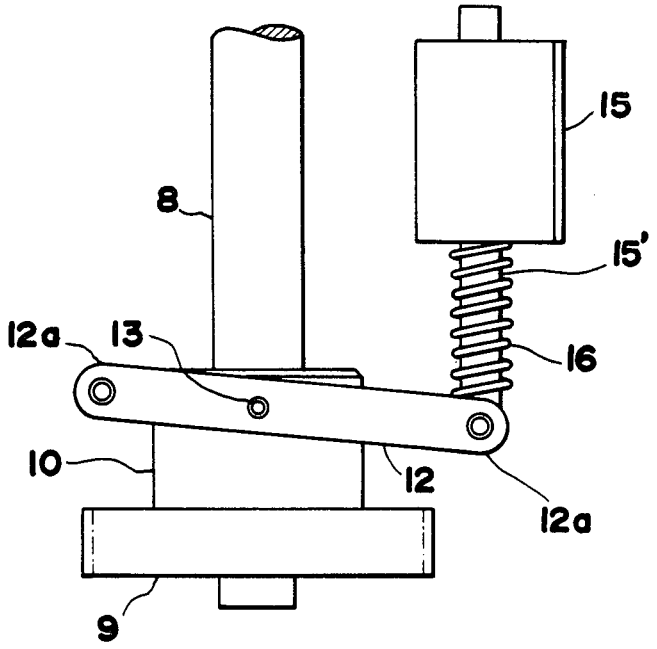
FIG. 4 is a schematic view showing the action of the clutch mechanism when the solenoid is deenergized.
Figure 5:
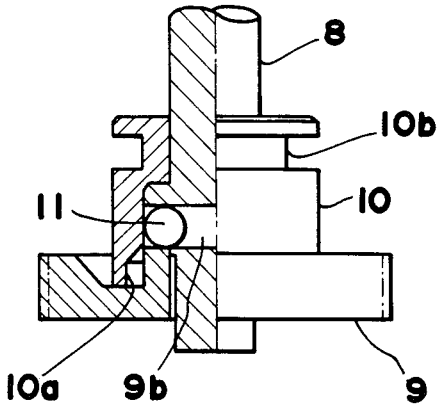
FIG. 5 is a cross-section showing the left-hand side of the clutch means shown in FIG. 4.
Figure 6:
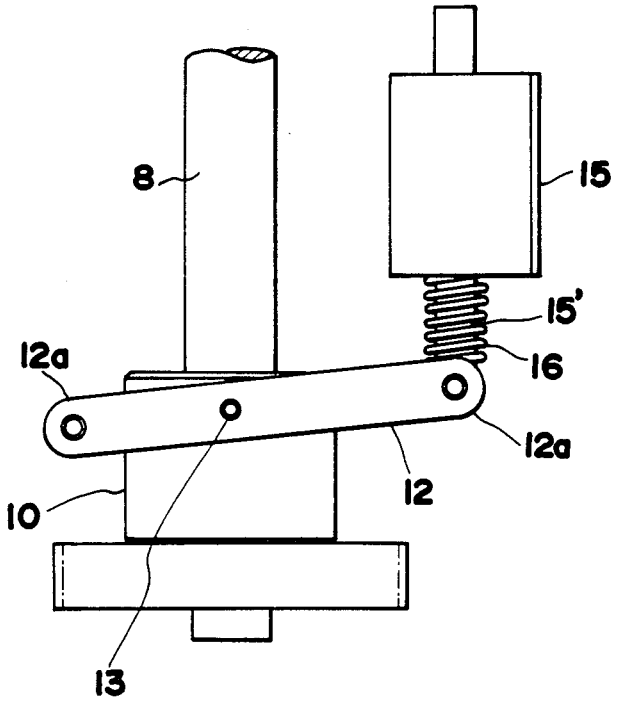
FIG. 6 is a schematic view corresponding to FIG. 4 when the solenoid is energized.
Figure 8:
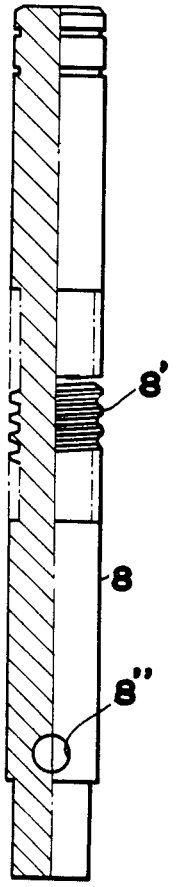
FIG. 8 is a partially sectional view showing a worm gearing mechanism.
Figure 7:
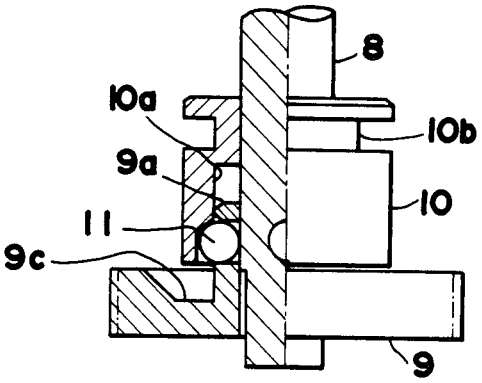
FIG. 7 is a cross-section showing the left-hand side of the situation shown in FIG. 6.
Figure 9:
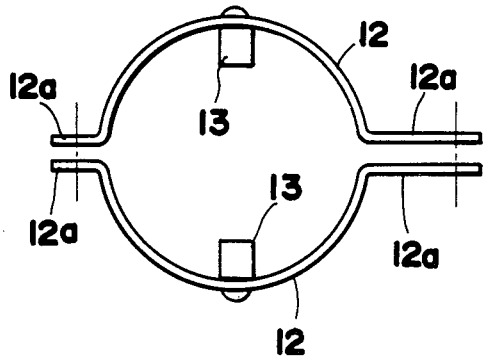
FIG. 9 is a plan view showing a clutch member included in the clutch mechanism shown in FIGS. 4 and 6.
Figure 10:
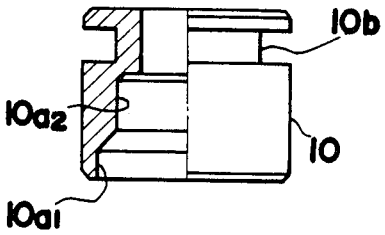
FIG. 10 is a front view showing another clutch member.
Figure 11:
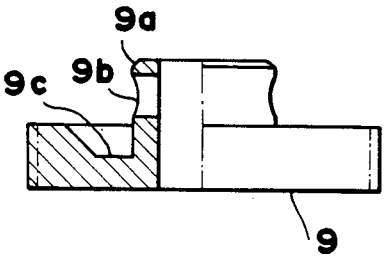
FIG. 11 is a vertical cross-section of a clutch gear constituting the clutch mechanism shown in FIGS. 4 and 6.
Figure 12:
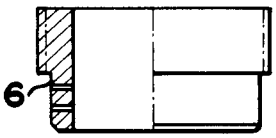
FIG. 12 is a partially sectional view showing a main gear operable in cooperation with the clutch means.

Referring to FIG. 11 the clutch gear 9 includes a projecting head **9*a* which has concave side 9*b*, and a ring-shaped groove 9*c* produced around the projecting head 9*a*. As shown in FIG. 7, a clutch wheel 10 is slidably mounted on the shaft 8 with a steel ball 11 interlocated between a recess $\mathbf{10}a_1$ produced in the clutch wheel 10 and the concave side 9*b*. The clutch wheel 10 has a further recess $\mathbf{10}a_2$, which is continuous to the recess $\mathbf{10}a_1$ as shown in FIG. 10, and a ring-shaped groove 10*b* along its periphery, in which a pair of levers 12 having flange poritons 12*a* are pivotally connected to the clutch wheel 10 (FIGS. 4 and 5) by means of pivots 13, which are inserted through bores 8'' produced in the lower part of the shaft 8. One pair of the flange portions 12*a* are pivotally connected to a bracket 14 jointed to the inner casing 2'. The other pair of flange portions 12*a* are pivotally connected to an actuater 15' of a solenoid 15. The reference numeral 16 denotes a compression spring wound around the actuater 15'**.

The reference numeral 17 denotes a worm wheel which is engaged with the worm gear 8' on the shaft 8, the worm wheel 17 being pivotally connected to the outer casing 2 and the inner casing 2'. A crank rod 18 is eccentrically and pivotally jointed to the worm wheel 17 at its lower end.

The pipe 4 is provided with a boss 19 moving up and down on the cylindrical surface thereof, and slots 20 axially produced. The reference numeral 21 denotes a rod having a pin 22 passed therethrough, which pin is carried on the boss 19 through the slots 20. In this way the rod 21 is suspended from the pin 20. The rod 21 is connected to the crank rod 18 at its middle portion, and is passed through a guide member 23 provided at an upper corner of the casing 2.

Fork-shaped arms 24 are radially provided on a bracket unit 25 rotatively carried on the boss 19 through bearings 26. A pull rod 27 is connected to each of the fork-shaped arm 24. The main vane 1 is provided with an auxiliary vane 28 whose angle of attachment is varied as desired. The auxiliary vane 28 is hinged to the main vane at its middle portion or slightly downward therefrom as shown in FIG. 1, wherein the hinge is indicated by the reference numberal 29. The pull rod 27 is connected to the auxiliary vane 28 at its opposite end to the fork-shaped arm 24, such that when the pull rod 27 is pulled, the auxiliary vane 28 is rotated in a counter-clockwise direction as shown by the arrow in FIG. 1.

The reference numeral 30 denotes a cylindrical bracket for supporting the pipe 4, the bracket 30 being directly attached to the ceiling. The reference numeral 31 denotes a cover for covering the casing 2 and an upper portion of the motor (M), the cover 31 being fixed to the casing 2.

In operation, the motor (M) is switched on. The main vanes 1 are rotated. Simultaneously, the main gear 6 is also rotated. At this stage, if the solenoid 15 is deenergized, the lever 12 is declined to the right in FIG. 2 under the action of the compression spring 16, which causes the clutch wheel 10 to lower thereby to allow the its undersurface to come into engagement with the ring-shaped groove 9c of the clutch gear 9. At the same time the steel ball 11 rises from the recess $10a_1$ to the recess $10a_2$. In this way the steel ball 11 fits in the concave side 9b on the clutch gear 9, thereby uniting the the clutch gear 9 and the shaft 8 through the clutch wheel 10.

At this stage, when the main gear 6 is placed into engagement with the clutch gear 9. The shaft 8 is caused to rotate. The worm gear portion 8' of the shaft 8 comes into gear with the worm wheel 17, thereby causing the worm wheel 17 to rotate. As a result, the crank rod 18 fixed to the worm wheel is raised or lowered in accordance with the rotating direction of the motor (M). In accordance with the rising or lowering of the crank rod 18 the rod 21 fixed thereto is equally raised or lowered, thereby causing the bracket unit 25 to move up or down along the pipe 4. In this way the pull rods 27 are pulled upward or pushed downward in accordance with the movement of the bracket unit 25. The auxiliary vanes 28 are repeatedly rotated in a clockwise direction and a counter-clockwise direction.

When the solenoid 15 is energized, the actuater 15' is withdrawn upward, thereby pulling the level 12 upward. The clutch wheel 10 is released from the clutch gear 9, and the steel ball 11 returns to the original recess $10a_1$. Thus the shaft 8 is released from the clutch wheel 10, and the rotation thereof is stopped.

As evident from the foregoing description, the combined motion of the main vanes 1 and the auxiliary vanes 28 is effected, thereby stirring up the air flow in the room. Thus warm air and cool air are mixed to equalize the room temperature. The angle of attachment of the auxiliary vanes 28 can be varied as desired by operating the solenoid 15.

To operate the auxiliary vanes, there is no need for providing an extra electric motor, but as described above, a single motor (M) is enough. This avoids increasing the cost. The cover 31 protects the casing 2 and the motor (M) against dust, and when it is painted with colorful designs or patterns, the ceiling fan will be ornamental to the room.

Since the auxiliary vanes 28 are hinged to the main vanes 1 at their middle portion or slightly downward thereof, the auxiliary vanes 28 ovecome a centrifugal force provided by the main vanes. The auxiliary vanes 28 are rotated in either direction by a light pull provided by the pull rods 27.

What is claimed is:

1. A ceiling fan comprising:

a main vane connected to a driving means through a shaft;

an auxiliary vane pivotally connected to a terminating end of the main vane;

a supporting means for suspending the fan from a ceiling, wherein the supporting means includes a casing;

a bracket unit slidably provided on the supporting means;

a rod member connecting between the auxiliary vane and the bracket unit;

a clutch means for effecting the connection and disconnection between the bracket unit and the driving means, the clutch means being accommodated in the casing; and a switch means for effecting the engagement and disengagement of the clutch means with the driving means.

2. A ceiling fan as set forth in claim 1, wherein the switch means is a solenoid.

3. A ceiling fan as set forth in claim 1, further comprising a cover for covering the casing and the driving means.

4. A ceiling fan as set forth in claim 1, wherein the auxiliary vane is fixed to the main vane at a point slightly downward of its middle portion.

* * * * *